United States Patent [19]

Helms et al.

[11] Patent Number: 4,938,404

[45] Date of Patent: Jul. 3, 1990

[54] APPARATUS AND METHOD FOR ULTRASONIC CONTROL OF WEB

[75] Inventors: Randall D. Helms; Robert A. Daane, both of Green Bay, Wis.

[73] Assignee: Advance Systems, Inc., Green Bay, Wis.

[21] Appl. No.: 380,125

[22] Filed: Jul. 14, 1989

[51] Int. Cl.[5] ..... B65H 23/00

[52] U.S. Cl. ..... 226/10; 226/197; 226/97; 226/7

[58] Field of Search ..... 226/7, 97, 197, 10; 384/100

[56] References Cited

U.S. PATENT DOCUMENTS

| | | | |
|---|---|---|---|
| 3,701,135 | 12/1972 | Price | 226/97 X |
| 4,197,972 | 4/1980 | Daane | 226/197 X |
| 4,282,998 | 8/1981 | Peekna . | |
| 4,327,859 | 5/1982 | Hirakawa et al. | 226/7 X |

*Primary Examiner*—Daniel P. Stodola
*Assistant Examiner*—Paul Thomas Bowen
*Attorney, Agent, or Firm*—Nilles & Nilles

[57] ABSTRACT

A turning guide for a running web and which guide has a curved guide surface with air slots therein and pressurized air supplied from a blower is delivered through a plenum to the guide to form a cushion of pressurized air which floatingly supports the web. An adjustable damper operated by a servomotor regulates air flow and controls the clearance spacing between the curved guide surface and the web. Control apparatus for the servomotor comprises an electronic control unit, including a memory and a central processing unit (CPU), to which are connected an ultrasonic signal generator, an ultrasonic signal receiver, temperature sensing devices located with the ultrasonic signal sensors, a sensor responsive to blower operation, and a sensor responsive to web presence. In operation, after a desired web clearance set-point is entered into the memory and blower operation and web presence are established, an ultrasonic signal from the signal generator is reflected off of the web to the signal receiver. The time interval between initiation and reception of the ultrasonic signal, compensated for ambient temperature, is compared to the stored web clearance set-point value and, if necessary, a control signal from the electronic control unit operates the damper servomotor to change the pressure of the air cushion and thus move the web relative to the running guide surface to establish and maintain the selected web clearance spacing.

6 Claims, 5 Drawing Sheets

APPARATUS AND METHOD FOR ULTRASONIC CONTROL OF WEB

BACKGROUND OF THE INVENTION

1. Field of Use

This invention relates generally to web processing apparatus wherein a web moving along a path is supported on a guide by a cushion of air without contacting the guide.

In particular, it relates to apparatus and method for ultrasonically controlling the position of the web to maintain it at a predetermined distance from the guide.

2. Description of the Prior Art

U.S. Pat. No. 4,282,998 entitled "Maintenance of Constant Web Clearance Turning Guide" issued Aug. 11, 1981 to Peekna discloses web processing apparatus wherein a change in direction of a running web is accomplished by means of a contactless running guide. In that guide, pressurized air from a source, such as a blower, is delivered into a plenum chamber from which it issues through slots in the guide that direct it between the web and a curved guide surface to form a pressurized air cushion on which the web floats out of contact with said guide surface. A damper that controls flow of pressurized air into the plenum chamber is automatically positioned by a servomotor so as to maintain a constant distance between the guide surface and the web, notwithstanding variations in web tension. Means for control of the servomotor comprise a supply pressure sensor that produces a first output corresponding to the above-atmospheric pressure of air in the plenum chamber, a cushion pressure sensor having an inlet at said guide surface that produces a second output corresponding to the above-atmospheric pressure in the air cushion, and a ratio-forming device to which said outputs are fed to produce a ratio signal corresponding to a ratio relationship between the first and second outputs. In a comparison device, the ratio signal is compared with a manually adjustable set-point signal to produce a control output signal which is applied to the servomotor so as to maintain said ratio relationship substantially constant.

SUMMARY OF THE PRESENT INVENTION

The present invention provides an improved apparatus and method for ultrasonically controlling the position of a web in web processing apparatus so as to position the web and maintain it at a predetermined constant distance from a contactless running guide of the aforesaid type.

The improved apparatus broadly comprises first means, including a blower and adjustable damper, which are operable to move a web (stationary or running) relative to a desired predetermined position with respect to a curved surface of a contactless running guide. The improved apparatus further comprises control means then operable to transmit an ultrasonic signal, reflect it off of the web and receive the reflected signal. The control means then operates to measure the time interval (i.e., the distance traveled in air) between transmission and reception of the ultrasonic signal and to effect temperature compensation of the time interval or distance signal (since the speed of sound in air varies with ambient air temperature) to thereby ascertain the actual position of the web relative to the desired predetermined position which is stored as a set-point signal. The control means then effects operation of a servomotor-driven adjustable damper to regulate air flow to the running guide and thereby move the web from its actual position into the predetermined desired position, if necessary, and maintain the web in the predetermined position.

The improved method of positioning a web (stationary or running) in a desired predetermined constant position relative to a surface of a contactless running guide broadly comprises the steps of: initiating an ultrasonic signal and reflecting it from the web to a receiver; measuring the time interval between initiation and reception of the signal, effecting temperature compensation of the time interval to ascertain the actual distance the signal has traveled and thus the actual position of the web; and, if necessary, moving the web from its actual position to the desired predetermined position and maintaining it in that position.

The present invention offers several advantages over the prior art. For example, the present invention directly ascertains actual web position by measuring its position and does not depend on indirect or secondary information pertaining to web position as is the case in U.S. Pat. No. 4,282,998 wherein information on web position is inferred from the ratio between air pressure values in the air supply plenum chamber and at the surface of the contactless running guide. Thus, the present invention more precisely ascertains web position and effects more precise adjustments than in the prior art.

Furthermore, unlike some prior art apparatus, the present invention can effect web position adjustment when the web is stationary, as before start-up or when the web is stopped, as well as when the web is running.

Also, unlike some control systems using ultrasonic signals, the present invention takes into account the fact that the speed of sound in air varies with the temperature of the air through which the signal travels and provides for temperature compensation of the signal to ensure great accuracy in the signal measurement.

The control means in accordance with the present invention is straight-forward in design, construction and mode of operation and can be installed as original equipment in web processing apparatus or can be retrofitted to replace and upgrade controls on web processing apparatus already in the field.

The improved control means uses some commercially available, proven components and this further ensures system reliability and reduces manufacturing and servicing costs.

Other objects and advantages of the invention will hereinafter appear.

DESCRIPTION OF A PREFERRED EMBODIMENT

Figure 1:
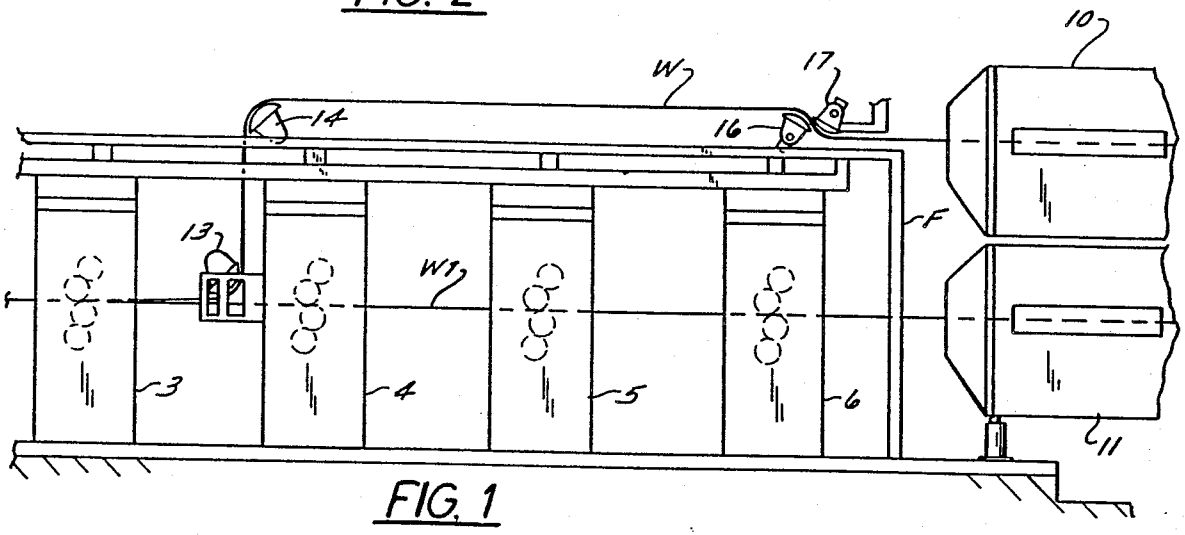
FIG. 1 is a schematic side elevation view of web processing apparatus having a series of web presses from which a web is fed into a web dryer, and showing the environment in which the present invention is used.

The general environment in which the present invention is used is shown in FIG. 1 and includes a series of web presses 3, 4, 5 and 6 which are arranged in line in the conventional manner and through which two webs W and W1 pass to their respective web dryers 10 and 11. For the purpose of describing the present invention, reference will be made only to web W which, after leaving the last of its web presses 3, must be turned at two right angles to position it above the remaining presses 4, 5 and 6. Web W subsequently enters web dryer 10 for further processing. In conducting web W through its running path from the last printing press 3 to dryer 10, a pair of 90° turn contactless air guides 13, 14 and also a pair of 40° turn air guides 16, 17 are used to floatingly guide the web without contact with the air guides from the last web press 3 and into the web dryer 10. The air guides are understood to be angularly adjustable and supported on the press frame F in a conventional manner.

Figure 2:
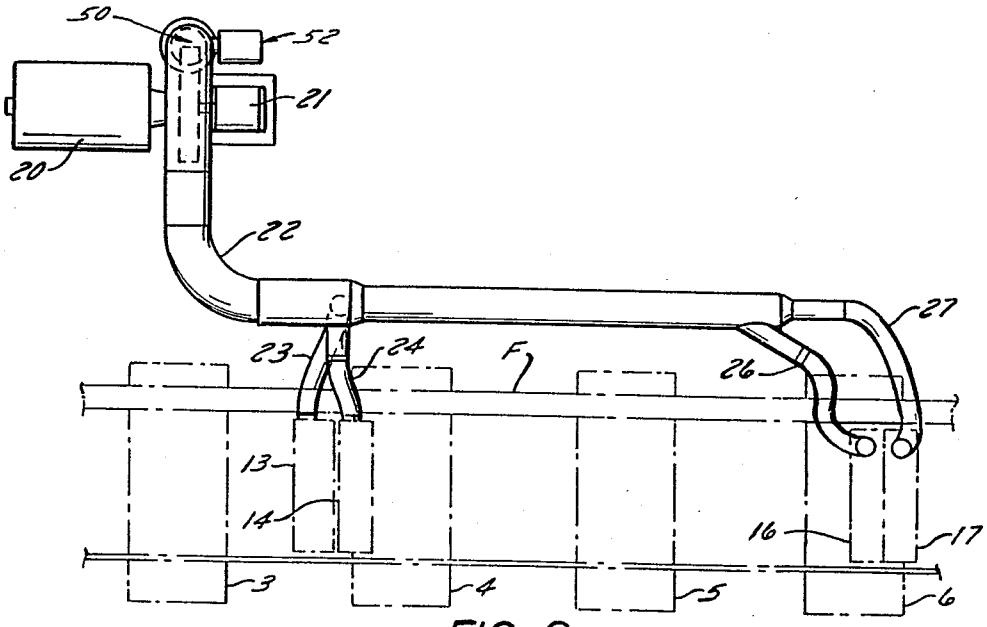
FIG. 2 is a schematic top plan view of the web processing apparatus shown in FIG. 1 and including the air supply means for contactless air guides used in the apparatus.
Figure 3:
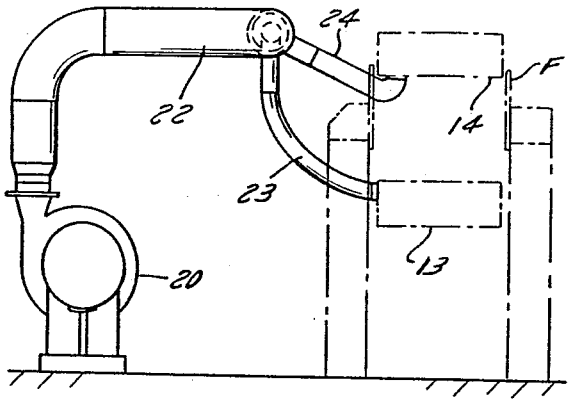
FIG. 3 is a schematic end elevation view of the air supply means and web presses shown in FIGS. 1 and 2.

As shown in FIGS. 2 and 3, a source of air such as a blower 20 driven by its motor 21 supplies air through a plenum comprising a main duct 22 and auxiliary ducts 23, 24 to furnish pressurized supply air, respectively, to the 90° air guides 13, 14. Main duct 22 also furnishes supply air to auxiliary ducts 26, 27 to furnish supply air, respectively, to the 40° air guides 16, 17.

Figure 4:
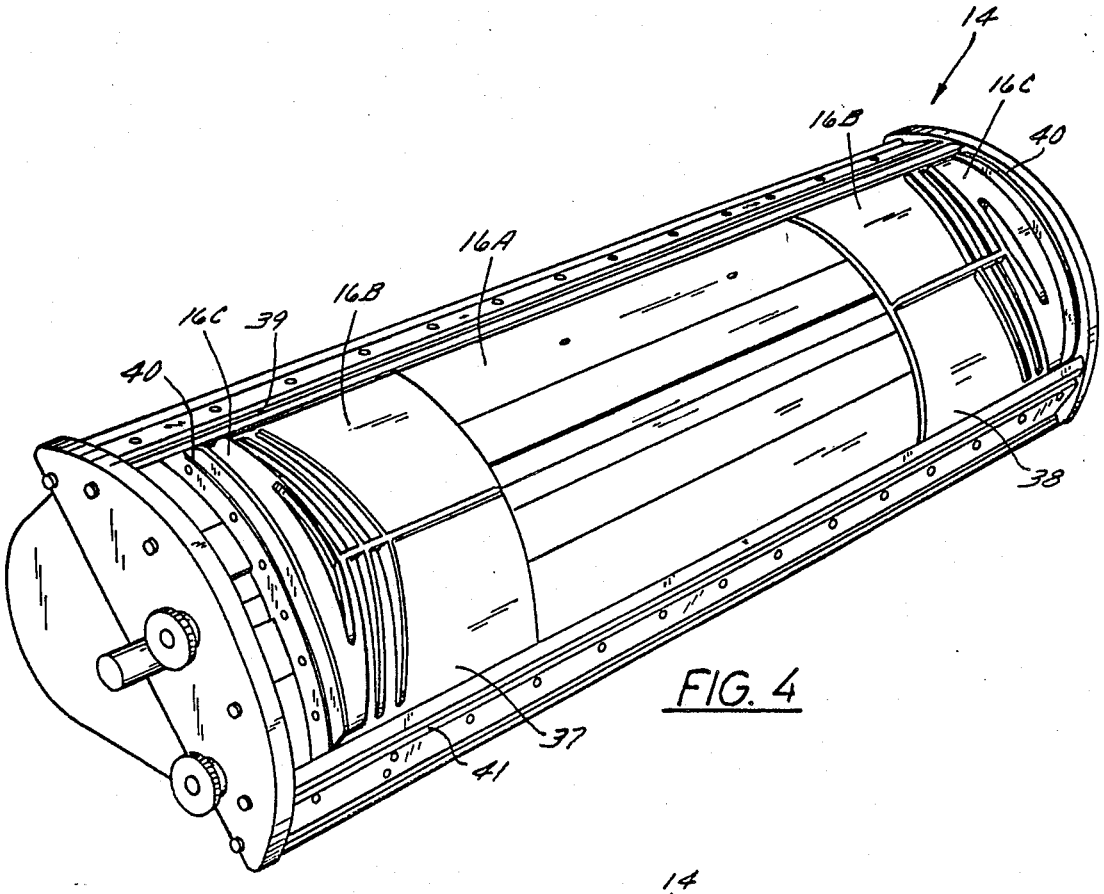
FIG. 4 is an enlarged perspective view of one of the 90° contactless air guides shown in FIGS. 1, 2 and 3.
Figure 5:
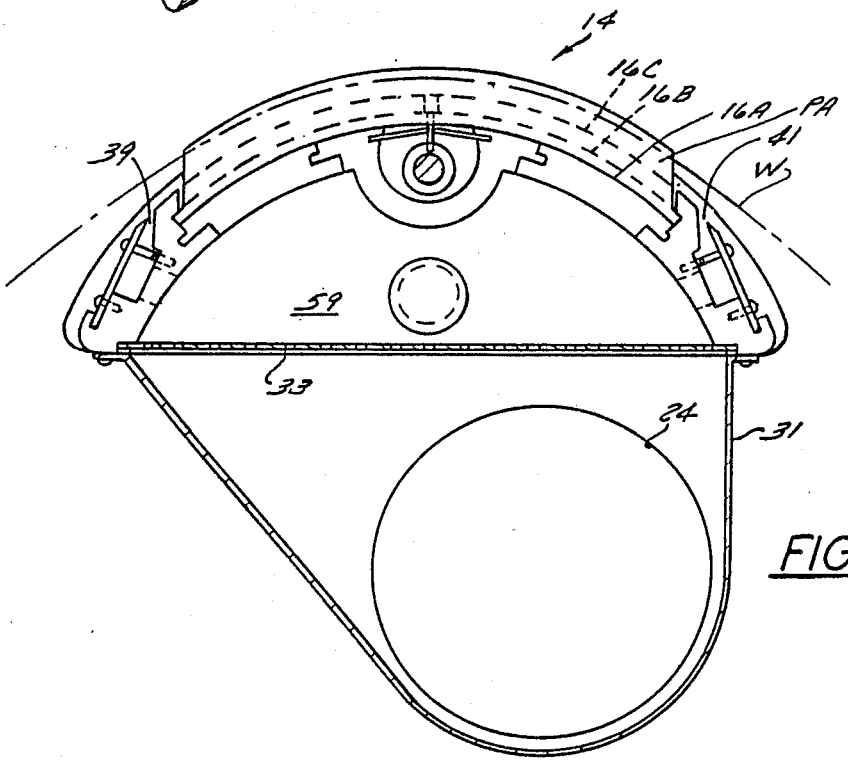
FIG. 5 is a schematic cross-section view of the contactless air guide of FIG. 4 showing the relationship of a web thereto.

Referring to FIGS. 4 and 5, air guide 14 will now be described in greater detail, it being understood that the construction of the other air guides 13, 16 and 17 is generally similar.

Air guide 14 has an air supply housing 31. Pressurized air is conducted from auxiliary duct 24 into housing 31 and through an internal perforated air distribution plate 33 which is fixed across the housing on the inside thereof. The air distribution plate 33 acts to distribute the air evenly along the length of the air guide now to be described in detail.

The guide 14 has a pair of air nozzle slots 39, 41 extending lengthwise along the guide and circumferentially spaced apart from one another, as shown in FIGS. 4 and 5. The slots 39, 41 are directed toward one another to provide pressurized air from inside housing 31 to form an air cushion PA between the opposed slots, and arcuate guide surfaces 16A, 16B, 16C and the underside of web W.

The guide 14 operates to floatingly suspend or support web W above guide surfaces 16A, 16B and 16C which extend arcuately in the direction of web movement. The guide 14 and its surface 16A are generally elongated and extend transversely across the path of movement of the running web. The cushion PA of pressurized air (FIG. 5) is formed between guide surfaces 16A, 16B, 16C and web W to floatingly suspend the web without contact with the arcuate web guide surfaces 16A, 16B and 16C. The cushion exists when the web is stationary or when it is running.

The cushion PA of air beneath web W has a tendency to try to escape out of each end of air guide 14 which would result in loss of cushion air pressure. Therefore, opposed air vane members 37, 38 are provided which are transversely spaced apart from one another to confine air cushion PA.

Air vane members 37 and 38, preferably fabricated of molded plastic, are provided, one being located at each end of guide 14. Vane members 37 and 38 are arcuate in shape to complement the arcuate guide surface 16A. Arcuate guide surfaces 16B and 16C are a part of opposed air vane members 37 and 38. The vane members 37 and 38 each have an edge dam 40 formed integrally therewith and the edge dam is located adjacent its respective web edge. The edge dam 40 is generally coextensive with the arcuate length of its respective air vane member 37, 38.

The edge dams 40 are adjustably locatable closely adjacent the edges of web W to thereby accommodate various web widths and "cross machine" web positions. The edge dams 40 prevent lateral escape of the air from beneath web W.

CONTROL MEANS AND METHOD

Referring to FIGS. 6 through 9, the present invention provides an improved apparatus and method for ultrasonically controlling the position of web W in the aforedescribed web processing apparatus so as to position the web and maintain it at a predetermined constant distance from curved guide surfaces 16A, 16B and 16C of contactless running guide 14, regardless of whether the web is stationary or running.

Figure 6:
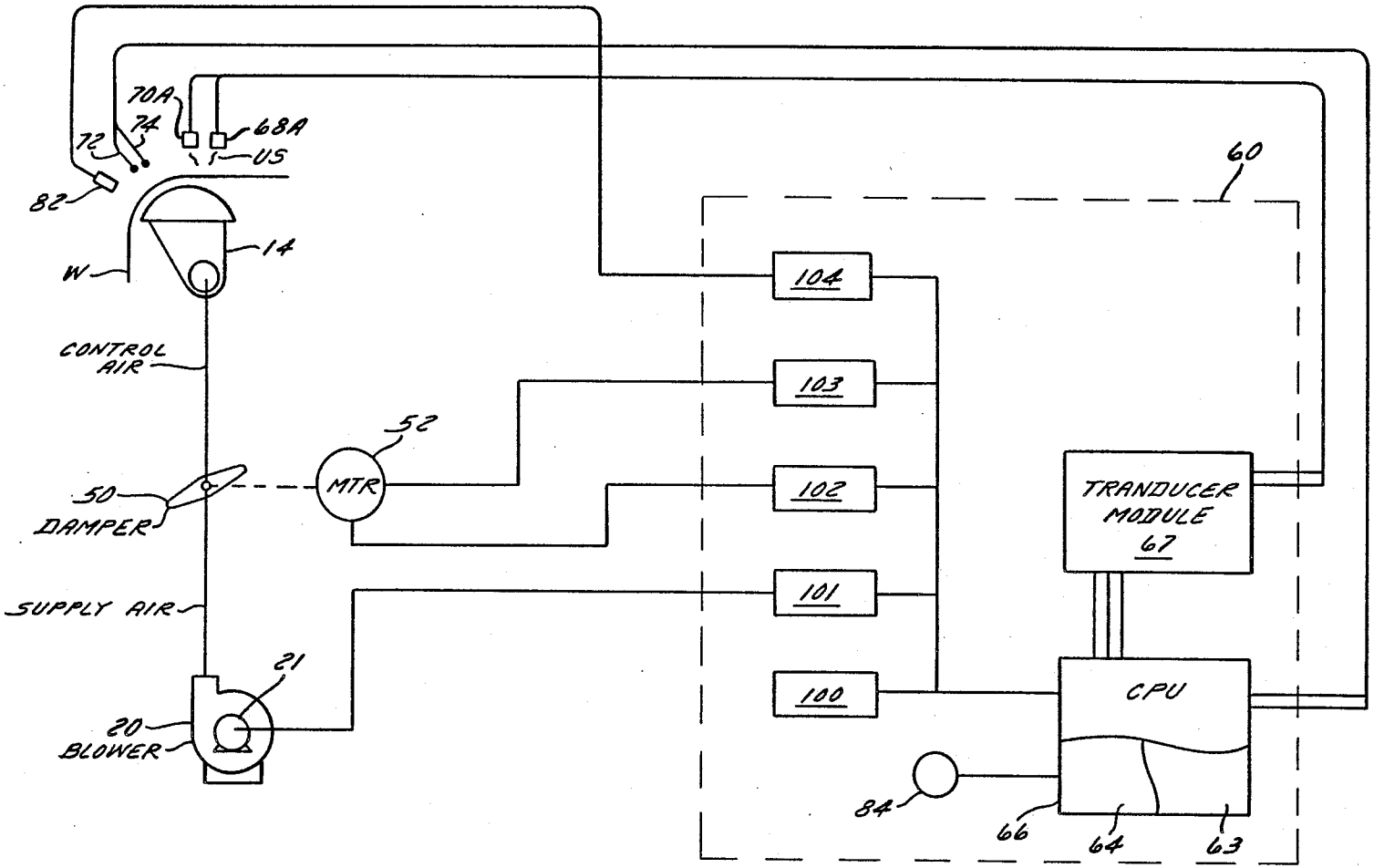
FIG. 6 is a schematic diagram of improved control means for a damper motor shown in FIGS. 2 and 3.

As FIG. 6 shows, the improved apparatus broadly comprises first means, including blower 20, plenum ducts 22 and 24 and an adjustable damper 50 located at blower 20 outlet and rotatably movable by a damper motor 52. The first means are operable, when damper 50 is adjustably moved, to move web W perpendicularly to its path of travel, while it is stationary or running, relative to a desired predetermined position with respect to guide surfaces 16A, 16B and 16C of contactless running guide 14.

The improved apparatus further comprises control means for damper motor 52, as hereinafter described in detail. The control means are operable to transmit an ultrasonic signal US, reflect it off of web W and receive the reflected signal. The control means also operates to measure the time interval between transmission and reception of the ultrasonic signal US and effects temperature compensation thereof (since the speed of sound in air varies with ambient air temperature) to thereby ascertain the actual position of web W relative to the predetermined desired position, such as the position shown in FIG. 5. If necessary, the control means then effects operation of damper motor 52 of adjustable damper 50 to regulate air flow (increase or decrease) to running guide 14 and thereby move web W into the predetermined desired position and maintain it in that position.

The improved method of positioning web W (whether stationary or running) in a desired predetermined constant position relative to contactless running guide 14 broadly comprises the steps of: initiating the ultrasonic signal US and reflecting it from web W to a receiver 70; measuring the time interval between initiation and reception of the signal US to ascertain the distance traveled in air by signal US and effecting temperature compensation thereof in accordance with ambient air temperature to ascertain the actual position of the web; and, if necessary, moving the web from its actual position to the desired predetermined position and maintaining it in that position.

As previously explained, web W is disposed around contactless running guide 14 to change the path of direction of web movement. The guide 14 has the curved guide surfaces 16A, 16B and 16C with air slots 39, 41 therein and pressurized air supplied from motor-driven blower 20 is delivered through plenum 22, 24 and chamber 59 and through the air slots 39, 41 to form the cushion PA of pressurized air which floatingly supports the web out of contact with curved guide surfaces 16A, 16B and 16C. The adjustable damper 50 is located at blower 20 outlet and is operated by selectively controllable electric servomotor 52 to regulate air flow in the cushion of air and, thus, controls the distance or web clearance spacing between curved guide surfaces 16A, 16B and 16C, and web W. Increased air flow increases web clearance and decreased air flow decreases web clearance.

Figure 7:
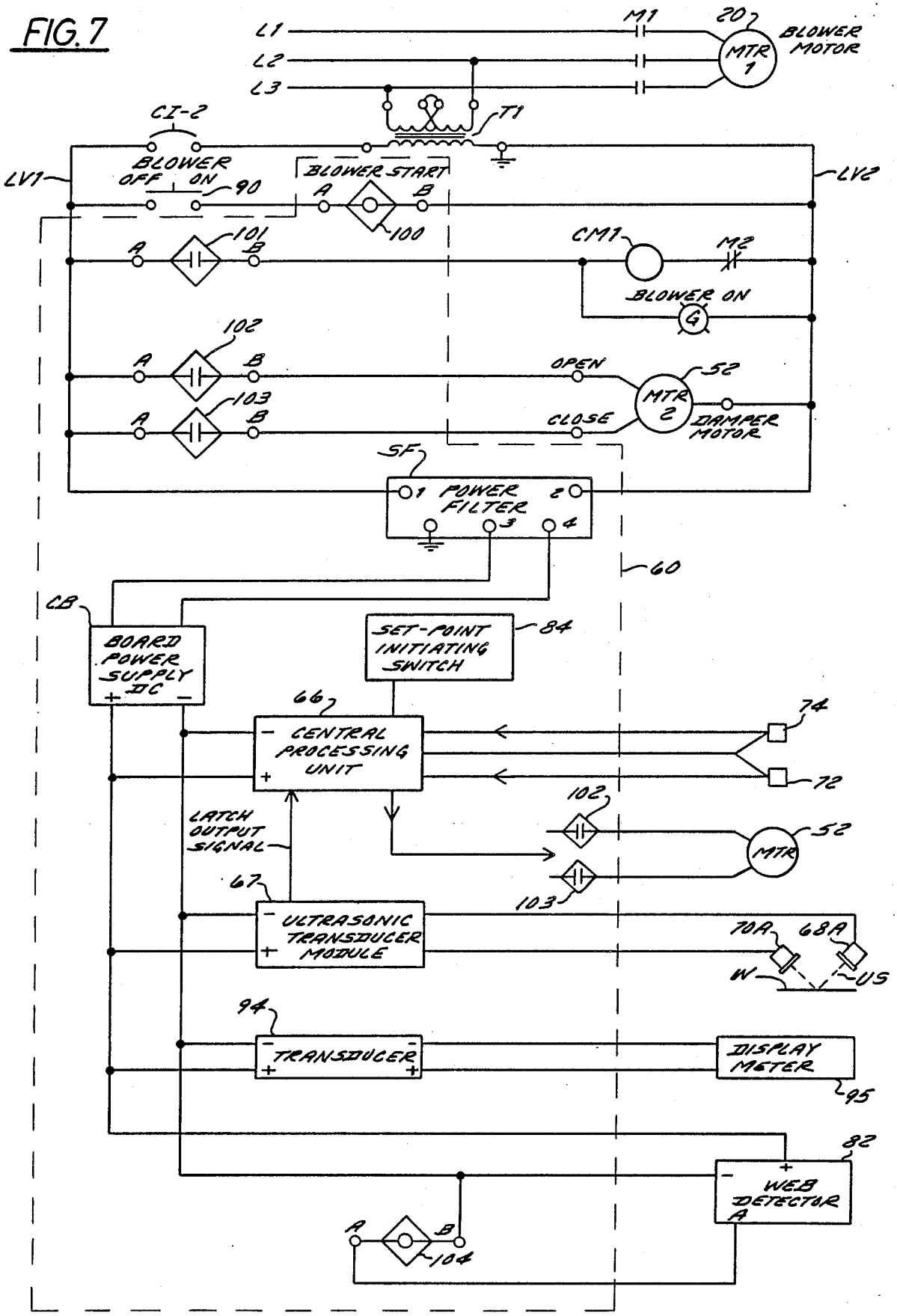
FIG. 7 is an electric circuit diagram of the control means shown in FIG. 6.

As FIGS. 6 and 7 show, the control means or control apparatus for servomotor 52 comprises an electronic control unit 60, including a central processing unit (CPU) 66, a timing circuit 63, a memory circuit 64, and a transducer module 67. Transducer module 67 comprises an ultrasonic signal generator 68 and an ultrasonic signal receiver 70 with external transducers 68A and 70A connected to the module 67 part of control unit 60. Also connected to control unit 60 are ambient air temperature sensing devices 72 and 74 which are mounted next to external transducers 68A and 70A at guide 14. A web clearance set-point initiating switch 84 is connected to central processing unit 66 part of control unit 60. Located in control unit 60 is a sensor in the form of a relay 101 which is responsive to blower operation. Located above web W near external transducers 68A, 70A and temperature sensors 72, 74 and connected to control unit 60 is a sensor 82 which is responsive to web presence.

In operation, after a desired web clearance set-point is entered into memory 64 by initiating switch 84 and blower operation and web presence are established and sensed, the ultrasonic signal US originating from signal generator 68 is reflected off of web W to signal receiver 70. The time interval between initial transmission and reception of the ultrasonic US pulse is measured and compensated for ambient air temperature detected by the temperature sensors 72 and 74 and the corrected signal, now representative of actual distance traveled by the US signal, is compared to the stored web clearance set-point signal. If necessary, i.e., if there is a difference in value between the temperature corrected measured signal and the stored signal, the magnitude and direction of the difference is computed and a control signal is provided from electronic control unit 60 to operate damper servomotor 52 to adjust the position damper 50 to change the pressure of air cushion PA and thus move web W relative to running guide surfaces 16A, 16B and 16C to establish and maintain the selected web clearance spacing.

Figure 8:
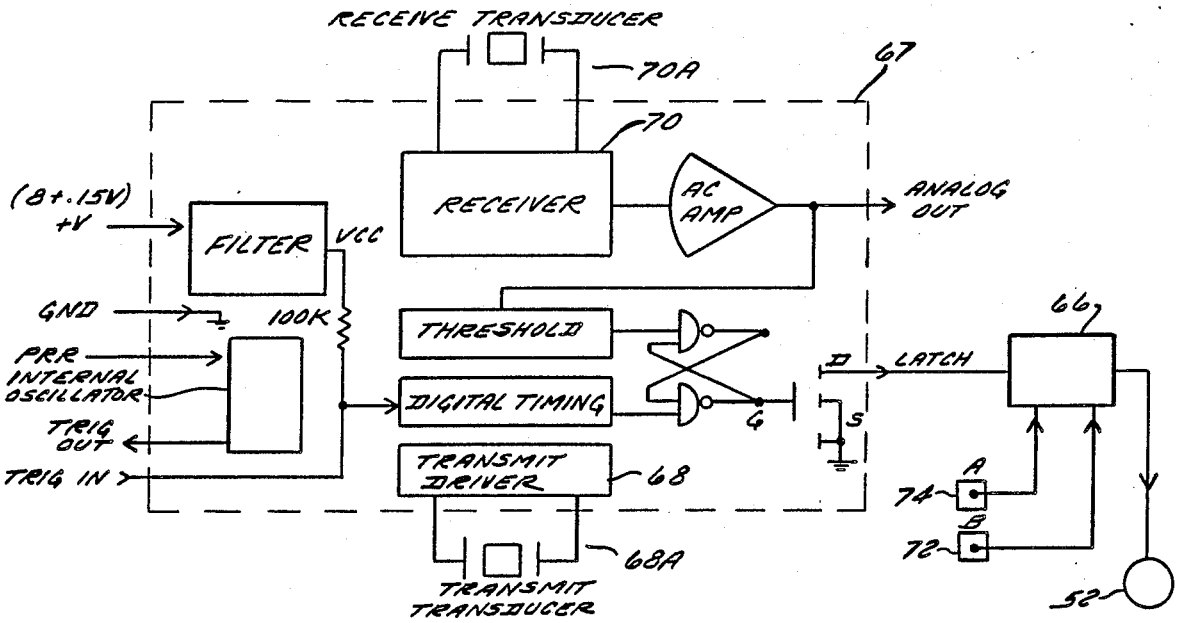
FIG. 8 is a functional block diagram of a portion of the electric circuit shown in FIG. 7.

Referring to FIGS. 6, 7 and 8, transducer module 67 takes the form of an ultrasonic ranging module, such as Model E-201A/215, which is commercially available from Massa Products Corporation, 280 Lincoln Street, Hingham, Mass. 02043.

The ultrasonic ranging module 67 is a precision electronic device which is employed with and provides interface circuitry for transmitting transducer 68A and receiving transducer 70A. A function block diagram for transducer module 67 is shown in FIG. 8. The module transmits a 215 KHz narrow beam acoustic ultrasonic pulse from transmitter 68 / transducer 68A and provides a digital LATCH output pulse. The receiver 70 / transducer 70A detects the transmitted acoustic ultrasonic pulse as a reflected echo from web W at which time the digital LATCH output pulse is not longer provided (see FIG. 8). The LATCH output pulse width is directly proportional to the distance the sound pulse US travels from the transmitting transducer 68A to web W and from the web W to receiving transducer 70A. The LATCH pulse is processed through additional circuitry for precision distance measurement, i.e., through the central processing unit 66 for temperature compensation, and a temperature compensated control signal is provided to effect operation of damper motor 52. The speed of sound in air is 1087 feet per second at standard temperature (32° F.) and standard atmospheric pressure (29.92 inches of mercury). Each change in temperature of 1° F. results in a change in the speed of sound on 0.1 percent, discounting changes in atmospheric pressure. The velocity in air is independent of the pressure, because the elasticity of the sound waves changes to compensate for the density changes. The chart shown below lists the performance characteristics of transducer module 67 and indicates the effect of temperature on transducer module 67. The central processing unit 66 shown in FIG. 8 receives signal input information from the thermistors 72 and 74 which are located next to external transducers 68A and 70A at guide 14 and measure the ambient air temperature on the upper side of web W through which the ultrasonic signal US travels.

CHART I

| Specifications of Transducer Module 67 | |
|---|---|
| Detection Range: | 3 to 24 inches (nominal) |
| Total Beam Angle: | 10° (no secondary lobes) |
| Frequency: | 215 kHz |
| Maximum Pulse Repetition Rate: | 100 pulses/second |
| LATCH Output Pulse Width: | 73.75 μsec/inch |
| (147.5 μsec/inch when detecting reflected echoes due to round trip travel of sound) | |

$$\text{Pulse Width vs. Temp.} = \frac{1}{13{,}044\sqrt{1+\frac{T}{273}}} \times 10^6\ \mu\text{sec/inch of total sound path}$$

where T = temperature °C.

| | |
|---|---|
| Digital Output (LATCH) Sink Current: | 30 ma @ Vds = 0.5 V |
| Resolution: | ±0.001 inch |
| Voltage Requirements: | +8 to +15 Vdc |
| Power Requirements: | 600 mW @ 15 Vdc (Nominal)<br>170 mW @ 8 Vdc (Nominal) |
| Temperature Range | |
| operating: | 0° to 70° C. |
| storage: | −25° to + 85° C. |
| Humidity: | 0 to 90% non-condensing |
| Weight | 5 Oz. |
| Electronics Module & Tranducers: | |
| All Specifications at 20° C. unless otherwise specififed. | |

The control unit 60 measures the time interval required for the ultrasonic signal to travel from transmitter transducer 68A, reflect off of web W and reach receiver transducer 70A. This time interval is proportional to the distance traveled. Both the time interval signal and distance signal will change as web W moves closer to or farther from guide surfaces 16A, 16B and 16C. The LATCH output pulse width is directly proportional to the distance traveled by the ultrasonic signal and is received by central processing unit 66 wherein it is modified in accordance with ambient air temperature signal information of the thermistors 72 and 74 so as to provide a control signal proportional to the actual distance traveled by the ultrasonic signal US which operates damper motor 52. Temperature compensating circuits per se, are known in the prior art.

Figure 9:
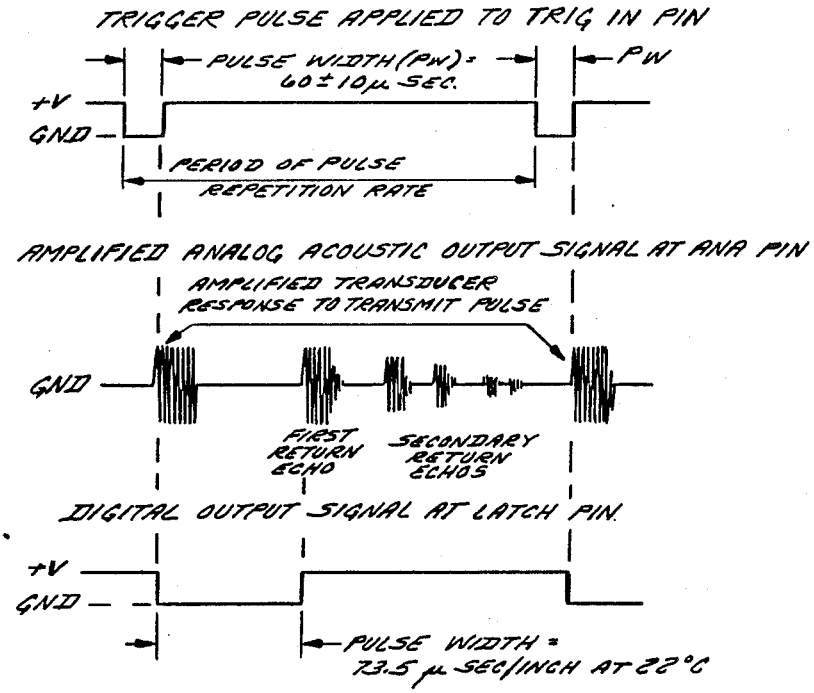
FIG. 9 is a timing diagram for the functional block diagram shown in FIG. 8.

Referring to FIG. 9, it is seen that the ranging module 67 is capable of being triggered up to a maximum pulse repetition rate of 100 pulses per second.

Referring to FIG. 7, there is shown an electric circuit diagram of the control means, including a source of electric power such as AC power supply lines L1, L2, L3 for energizing blower motor 20, damper motor 52, electronic control unit 60 including ultrasonic ranging module 67, and various control relays and circuits employed therewith.

More specifically, blower motor 20 is connectable to power lines L1, L2, L3 through a set of motor contactor contacts M1.

A step-down transformer T1 is tapped into power lines L2 and L3 and supplies power to low-voltage power lines LV1 and LV2 through a master circuit interrupter (overload protection) CI-2.

A blower start input relay 100 is connected in series with a momentary contact on-off push button switch 90 across lines LV1 and LV2. Output relay contact 101 is connected in a series with coil CM1 for motor contactor contacts Ml and a normally closed overload contact M2 across lines LV1 and LV2. A blower-on indicator light G is parallel with coil CM1 and contact M2.

Output relay contact 102 is in series with the damper open winding (not shown) of damper motor 52 across lines LV1 and LV2.

Output relay contact 103 is in series with the damper close winding (not shown) of damper motor 52 across lines LV1 and LV2.

Input relay 104 provides a signal to central processing unit 66 from web detector sensor 82.

A power supply filter SF is connected across lines LV1 and LV2 and supplies filtered AC power to a circuit board power supply module CB which has low voltage DC power output lines DC (+) and DC (−). Power supply module CB supplies operating power to central processing unit 66, ultrasonic ranging module 7, to transducer 94 for display meter 95 and to a web presence detector circuit 82 to which input relay 104 is connected. Referring now to FIG. 7, a typical operating cycle of the circuitry shown therein for operating blower motor 20 and damper motor 52 will now be described. Assume master circuit interrupter CI-2 is closed. Blower on-off push-button switch 90 is a momentary contact switch. When switch 90 is depressed blower start input relay 100 sees the power pulse and closes output relay contact 101 which energizes blower starter coil CM1 to start blower motor 20 and illuminates blower "on" light. If output relay contact 101 is already closed and blower start input relay 100 sees a power pulse, input relay 100 opens output contact 101, thus shutting off blower motor 20. If output relay contact 101 is closed (i.e., blower motor 20 is running) and input relay 104 sees power from detector 82 (web presence detected), the output relay contact 102 (damper motor open) and output relay contact 103 (damper motor close) are active, depending on signals from the electronic control unit 60.

Output relay contact 103 (damper motor close) is also active whenever output relay contact 101 is open (blower off) or when both output relay contact 101 is closed (blower on) and input relay 104 does not see power (no web presence detected).

We claim:

1. Web processing apparatus comprising:

a contactless web guide;

first means operable to support a web in spaced apart relationship from said contactless web guide;

and control means operable to transmit, reflect off of said web, and receive an ultrasonic signal which travels through air to ascertain the actual position of said web relative to a predetermined position with respect to said web guide by measuring the distance traversed by said ultrasonic signal between transmission and reception thereof by measuring the time interval between transmission and reception of said ultrasonic signal and by effecting temperature compensation of said time interval in accordance with the ambient temperature of the air through which said ultrasonic signal travels; and to effect operation of said first means to move said web from said actual position to said predetermined position.

2. Web processing apparatus according to claim 1 wherein said first means comprises a blower for supplying pressurized air to said contactless web guide and an adjustable damper for controlling air flow between said blower and said contactless web guide; and wherein said control means effects operation of said first means by adjusting said damper.

3. Web processing apparatus comprising:

a contactless web guide (14) having guide surfaces (16A, 16B, 16C);

a blower (20) operable to supply air to said web guide to provide a cushion (PA) of air between said guide surfaces and a web (W) for supporting said web in spaced apart relationship from said guide surfaces;

an adjustable damper (50) operable for regulating air flow to said cushion of air to position and maintain said web in a predetermined position relative to said guide surfaces;

and control means for adjusting said damper comprising:

an electronic control circuit (60) comprising a memory circuit (64), a central processing unit (CPU) 66, a timing circuit (63), and a transducer module 67;

ultrasonic (US) signal generating means (68) comprising a signal generating transducer (68A) for providing a US signal and for reflecting it off of a web;

ultrasonic signal receiving means (70) comprising a signal receiving transducer (70A) for receiving the reflected ultrasonic signal;

a set-point initiating means (84) for providing a set-point signal indicative of said predetermined position to said memory circuit (64) for storage therein;

said transducer module (67) being operable to generate, transmit and receive said ultrasonic signal and to provide a latch signal based thereon;

said timing circuit (63) being operable to measure the time interval between initiation and reception of said ultrasonic signal based on said latch signal and to provide a distance signal proportional to the distance traveled by said ultrasonic signal;

temperature sensing means (72, 74) for providing a temperature signal proportional to the temperature of the air through which said ultrasonic signal travels;

said central processing unit (66) being operable for receiving said distance signal and said temperature signal, for modifying said distance signal in accordance with said temperature signal, for comparing said modified distance signal (temperature compensated) to said stored set-point signal, and for providing a control signal to adjustably operate said damper (50).

4. A method of positioning a web in a predetermined position comprising the steps of:

initiating an ultrasonic signal and reflecting the ultrasonic signal from a web to a receiver through air;

measuring the distance traversed by said ultrasonic signal between initiation and reception thereof to ascertain the actual position of said web relative to said predetermined position, the steps of measuring the distance comprising the steps of measuring the time interval between initiation and reception of the ultrasonic signal, measuring the ambient temperature of the air through which said ultrasonic signal travels, and effecting temperature compensation of said time interval in accordance with said ambient temperature;

and moving said web from said actual position to said predetermined position.

5. A method of positioning a web which supported in spaced apart relationship from a contactless web guide in web processing apparatus by a cushion of air supplied to the contactless web guide by a blower through an adjustable damper comprising the steps of:

initiating an ultrasonic signal and reflecting the ultrasonic signal from a web to a receiver;

measuring the distance traversed by said ultrasonic signal between inflation and reception thereof to ascertain the actual position of said web relative to said predetermined position, the step of measuring the distance comprising the steps of measuring the time interval between initiation and reception of the ultrasonic signal, measuring the ambient temperature of the air through which said ultrasonic signal travels, and effecting temperature compensation of said time interval in accordance with said ambient temperature;

and moving said web from said actual position to said predetermined position by adjusting said damper.

6. A method according to claim 5 further comprising the steps of determining that a web is present and that said blower is in operation prior to initiating processing of said ultrasonic signal.

* * * * *